US008365920B2

(12) United States Patent
House et al.

(10) Patent No.: US 8,365,920 B2
(45) Date of Patent: Feb. 5, 2013

(54) CARTON FOR RECEIVING AND DISPLAYING CONTENTS

(75) Inventors: Richard F. House, Albuquerque, NM (US); Scott Thomas Strand, Lake Elmo, MN (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 13/083,736

(22) Filed: Apr. 11, 2011

(65) Prior Publication Data

US 2011/0248075 A1 Oct. 13, 2011

Related U.S. Application Data

(60) Provisional application No. 61/323,083, filed on Apr. 12, 2010.

(51) Int. Cl.
*B65D 5/50* (2006.01)
*B65D 75/00* (2006.01)

(52) U.S. Cl. ..... 206/780; 206/430; 206/499; 206/782; 229/87.05

(58) Field of Classification Search ..... 206/428, 206/430, 499, 525, 780, 782, 784, 526, 779; 229/87.01–87.03, 87.07–87.08, 87.15, 103.2, 229/87.05; 426/107, 113, 115, 122, 123
See application file for complete search history.

(56) References Cited

U.S. PATENT DOCUMENTS

| | | | | |
|---|---|---|---|---|
| 3,411,696 | A * | 11/1968 | Ayer et al. | 206/525 |
| 4,013,798 | A * | 3/1977 | Goltsos | 426/107 |
| 4,141,448 | A * | 2/1979 | Mascia et al. | 206/431 |
| 4,247,004 | A | 1/1981 | Bird | |
| 4,253,600 | A | 3/1981 | Schubert | |
| 4,308,949 | A | 1/1982 | House | |
| 4,331,238 | A | 5/1982 | Hanko et al. | |
| 4,573,634 | A | 3/1986 | Kohler et al. | |
| 5,148,972 | A | 9/1992 | Clayton | |
| 5,263,633 | A * | 11/1993 | Bicksler et al. | 229/87.08 |
| D347,998 | S * | 6/1994 | Steenwinkel | D9/702 |
| 5,609,379 | A | 3/1997 | Harrelson | |
| 5,730,353 | A * | 3/1998 | Holley, Jr. | 206/430 |
| 6,092,719 | A | 7/2000 | Capo | |
| 6,105,774 | A * | 8/2000 | Jackson | 206/499 |
| 7,063,231 | B2 | 6/2006 | Stanos et al. | |
| 7,273,162 | B2 | 9/2007 | Baker | |
| D553,496 | S | 10/2007 | Martuch et al. | |
| 7,546,924 | B2 | 6/2009 | Oliveira | |
| 7,862,318 | B2 | 1/2011 | Middleton et al. | |
| D635,852 | S | 4/2011 | Jenkins | |

FOREIGN PATENT DOCUMENTS

WO WO9400357 * 1/1994

* cited by examiner

*Primary Examiner* — Bryon Gehman

(74) *Attorney, Agent, or Firm* — Womble Carlyle Sandridge & Rice, LLP

(57) ABSTRACT

A carton includes opposite top and bottom end panels, and side panels extending between the top and bottom end panels. The side panels may at least partially define first, second and third openings. The first, second and third openings may be spaced apart from one another around the interior space of the carton. A container may simultaneously be both within the interior space of the carton, and projecting outwardly from the interior space of the carton through each of the first, second and third openings.

30 Claims, 11 Drawing Sheets

CARTON FOR RECEIVING AND DISPLAYING CONTENTS

CROSS-REFERENCE TO RELATED APPLICATION

This application claims the benefit of U.S. Provisional Application No. 61/323,083, which was filed on Apr. 12, 2010.

Incorporation by Reference

The entire contents of U.S. Provisional Application No. 61/323,083, which was filed on Apr. 12, 2010, is incorporated herein by reference.

BACKGROUND OF THE DISCLOSURE

In accordance with one aspect, this disclosure pertains to a carton that simultaneously contains and displays contents of the carton.

SUMMARY OF THE DISCLOSURE

One aspect of this disclosure is the provision of a carton for receiving and displaying contents, wherein the contents may include or be in the form of one or more containers. The carton may include one or more openings that may be in the form of gap(s) serving as open viewing window(s) for displaying the container(s) within the carton. In one embodiment, the gap(s) provide high visibility of the container(s). The gap(s) may be defined between band-like side panels of the carton, so that the gap(s) are located at and extend along respective upright corners of the carton. The gap(s) may be formed by cutting away one or more of the upright corners of the carton, or more specifically by cutting out and removing respective portions of the blank from which the carton is erected. The gap(s) may also extend into the top panel and/or the bottom panel of the carton, so that one or more ends of the gap(s) are defined by cutout(s) in the top panel and/or the bottom panel.

According to one aspect of this disclosure, the container(s) may be food containers that are constructed of a substantially clear material so that the contents of the container(s) may be seen through the carton's gap(s). In addition, each container's top or opening may be wider than its base; the containers may be arranged in a stack, such as by two of the containers being in a top-to-top orientation; and the carton may substantially conform to the shape of the stacked containers so that the middle of the carton is wider than the top and bottom ends of the carton.

In one aspect of this disclosure, at least one of the upright corners of the carton may include a corner panel that spans between the side panels that are adjacent to the upright corner. The corner panel may substantially conform to corner(s) of the container(s) within the carton. The corner panel may include an opening feature for aiding in opening of the carton. The opening feature may be a tear strip or any other suitable opening feature.

In accordance with one aspect of this disclosure, a package includes a carton and a container. The carton may include opposite top and bottom end panels, and a plurality of side panels extending between the top and bottom end panels. The plurality of side panels may extend at least partially around an interior space of the carton, and the plurality of side panels may at least partially define first, second and third carton openings. The first, second and third carton openings may be spaced apart from one another around the interior space of the carton. The plurality of side panels may be a front panel, a rear panel, a right panel and a left panel. The first carton opening may include or be in the form of a gap defined between the front panel and the left panel. The second carton opening may include or be in the form of a gap defined between the left panel and the rear panel. The third carton opening may include or be in the form of a gap defined between the rear panel and the right panel. The carton may be formed from a single blank.

The container may simultaneously be within the interior space of the carton, and projecting outwardly from the interior space of the carton through each of the first, second and third carton openings. The container may be a first container, and the package may further include a second container that is simultaneously positioned within the interior space of the carton with the first container, and projects outwardly from the interior space of the carton through each of the first, second and third carton openings. Each of the first and second containers may include first, second and third corners respectively projecting outwardly from the interior space of the carton through the first, second and third carton openings.

One aspect of this disclosure is the provision of a carton blank. In one example, the carton includes first and second panels that are spaced apart from one another, and one or more panels are positioned between and foldably connected to the first and second panels. The one or more panels positioned between and foldably connected to the first and second panels may include a first plurality of panels foldably connected to the first panel, and a second plurality of panels foldably connected to the second panel. An end of the first plurality of panels may be proximate an end of the second plurality of panels, and at least one of the first and second plurality of panels may be curved so that the first and second plurality of panels extend divergently with respect to one another in a direction extending away from the proximate ends of the first and second plurality of panels.

In another example, for each panel of the first and second panels of the blank, the panel includes a plurality of edges and a plurality of recessed corners, and the recessed corners are respectively positioned between pairs of the edges. For each recessed corner, it may be in the form of or include a substantially convex edge that protrudes toward, and is distant from, a center of the respective panel of the first and second panels.

Other aspects of this disclosure include a method of forming a carton from a blank, and a method of accessing one or more containers within the carton.

The foregoing presents a simplified summary of some aspects of this disclosure in order to provide a basic understanding. The foregoing summary is not an extensive overview of the disclosure and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are not necessarily drawn to scale, and wherein.

DETAILED DESCRIPTION

Figure 1:
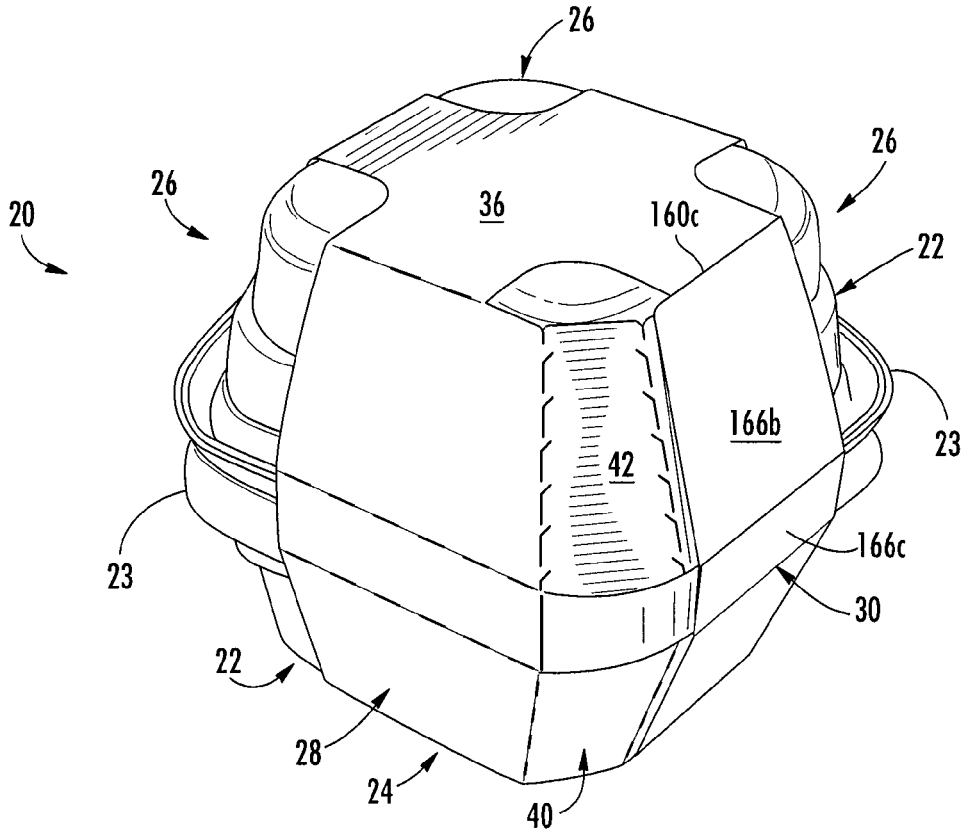
FIG. 1 is a front, right, top pictorial view of a package comprising two containers in a carton, in accordance with an exemplary embodiment of this disclosure.
Figure 2:
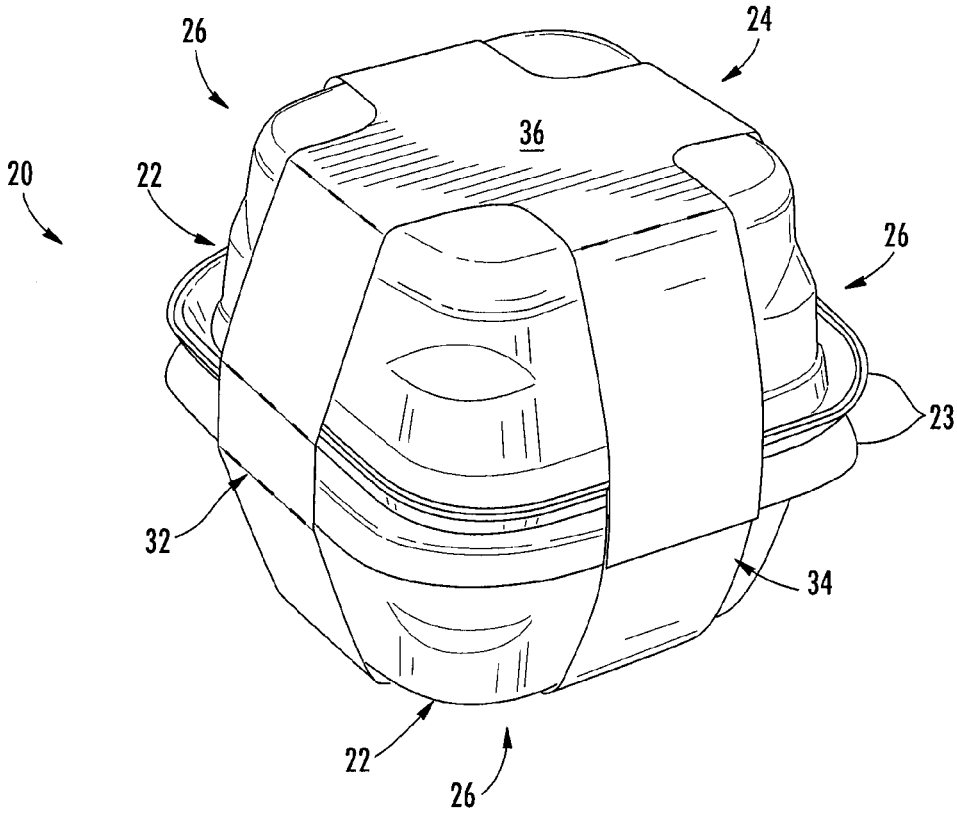
FIG. 2 is a left, rear, top pictorial view of the package of FIG. 1.
Figure 3:
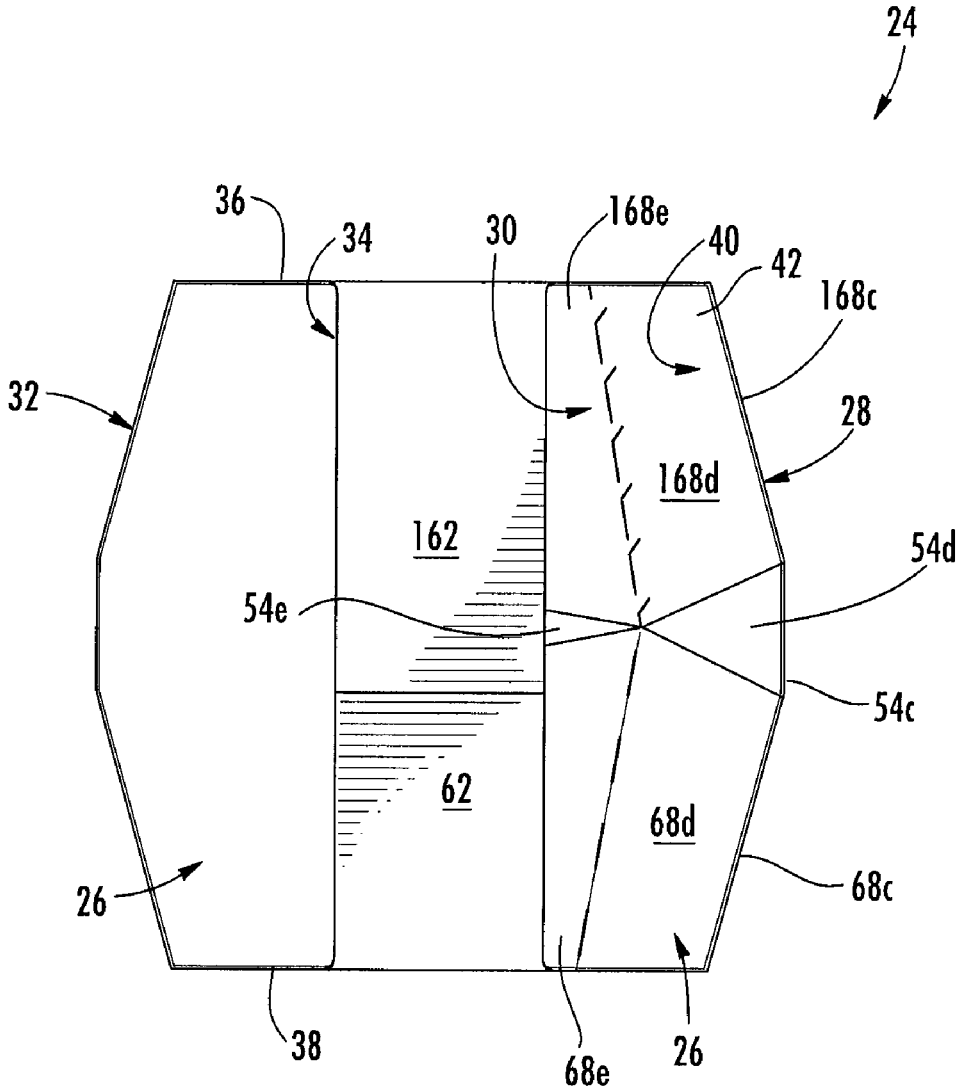
FIG. 3 is an isolated, left elevation view of the carton of FIG. 1.
Figure 4:
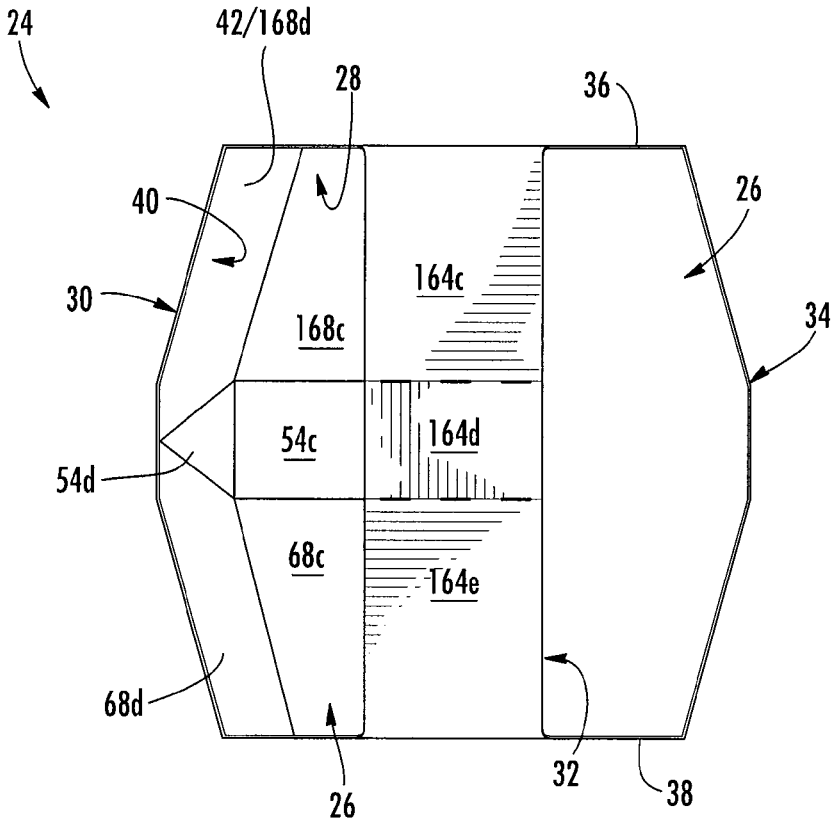
FIG. 4 is an isolated, rear elevation view of the carton of FIG. 1.

Referring now in greater detail to the drawings, in which like numerals refer to like parts throughout the several views, an exemplary embodiment is described in the following. In accordance with the exemplary embodiment, a package 20 includes contents within a carton 24. The contents within the carton may include, or be in the form of, one or more containers 22. More specifically, FIGS. 1 and 2 are pictorial views of the package 20 comprising two containers 22 that are arranged in a stacked configuration and at least partially contained in the carton 24. The carton 24 is configured to simultaneously contain and partially display the containers 22. More specifically and as shown in FIGS. 1 and 2, the carton 24 provides high visibility of the containers 22 while they are partially contained in the interior space of the carton.

The containers 22 may optionally be at least partially constructed of a substantially clear or at least generally clear material so that contents within the containers are at least partially visible or highly visible while the package 20 is fully intact. The contents of the containers 22 may be any types of items that are typically contained in containers. More specifically, the contents of the containers 22 may be food items, such that the containers may be characterized as being food containers. Typically each of the food containers 22 is tightly sealed with a lid 23, although other containers are within the scope of this disclosure. For example, the lids 23 may be optional, and one of the containers 22 may serve as a lid, or the like for, the other container.

In accordance with the exemplary embodiment, each of the containers 22 is in the form of a tall tray or a substantially square bowl, and the lid 23 is removably fit onto a peripheral lip of the container for closing the opening to the interior of the container. For each container 22, a peripheral lip of the container extends around the opening to the interior of the container, and the lid 23 includes a peripheral lip adapted for providing an interference fit with the lip of the container. The container 22 and lid 23 are typically constructed of a resilient material, and the interference fit typically comprises a friction fit such that the lid may be "snapped" onto or off of the container, and a substantially hermitic seal is provided between the container and the lid when the lid is fully installed onto the container. In a top plan view thereof, each container 22 and lid 23 is shaped substantially like a square, with rounded corners. More generally and in a top plan view thereof, each container 22 and lid 23 may be shaped substantially like a parallelogram with rounded corners. Each container 22 is tapered from top to bottom, such that its lip/top end/opening is wider than its base, for allowing the containers to be nested together in a conventional manner, although they are not nested in the drawings of this disclosure.

More specifically, for each container 22 in its upright configuration, its four upstanding walls and four rounded corners extend upwardly from the base, and the walls and corners together extend around the cavity of the container. The peripheral lip of the container 22 is in the form of a flange that protrudes outwardly from the upper edges of the walls and corners. The walls and corners extend upwardly/obliquely/outwardly from the base. That is, typically, the walls and corners are inclined outwardly so that a series of the containers 22 can be arranged in a nested stack, as mentioned above. Notwithstanding the foregoing, the containers 22 may be in any suitable shape. For example, the containers 22 may be more rounded, such as by being round containers or bowls.

In the package 20, the containers 22 are stacked in a top-to-top orientation. More specifically, the lids 23, which are respectively fastened to the lips of the containers 22, are in opposing-face-to-face relation, or more specifically in opposing-face-to-face contact, with one another, and except for being inverted with respect to one another the containers 22 are symmetrically arranged. Alternatively, the lids 23 may be omitted such that the lips of the containers 22 are in opposing-face-to-face contact with one another. The carton 24 substantially conforms to the containers in the top-to-top arrangement, such that the middle of the carton is wider (both front to rear and right to left) than the top and bottom ends of the carton. Predetermined corners are omitted from the carton 24 so that the carton defines elongate opening or gaps 26 (e.g., open viewing windows) through which the containers 22 and optionally also their contents may be seen.

Referring to FIGS. 1-4, the carton 24 includes front (e.g. first), right ((e.g. third), rear (e.g. second) and left (e.g. fourth) side panels 28, 30, 32, 34 that span between top and bottom end panels 36, 38. As a collective unit, the front, right, rear and left side panels 28, 30, 32, 34 extend at least partially around the interior space of the carton 24, and more specifically the front, right, rear and left side panels collective extend only partially around the interior of the carton, because of the gaps 26. Between each of the adjacent side panels 28, 30, 32, 34, a respective one of the gaps 26 is defined and typically extends into each of the end panels 36, 38, except that any gap between the front and right side panels 28, 30 may be obstructed (e.g., substantially closed) by a corner panel 40. The corner panel 40 may include a tear strip 42 that may be used (e.g., torn away from the carton 24) for facilitating opening the carton 24, as discussed in greater detail below. Alternatively, the tear strip 42 may be replaced with any other suitable opening feature or the tear strip may be omitted, as discussed in greater detail below.

Figure 5:
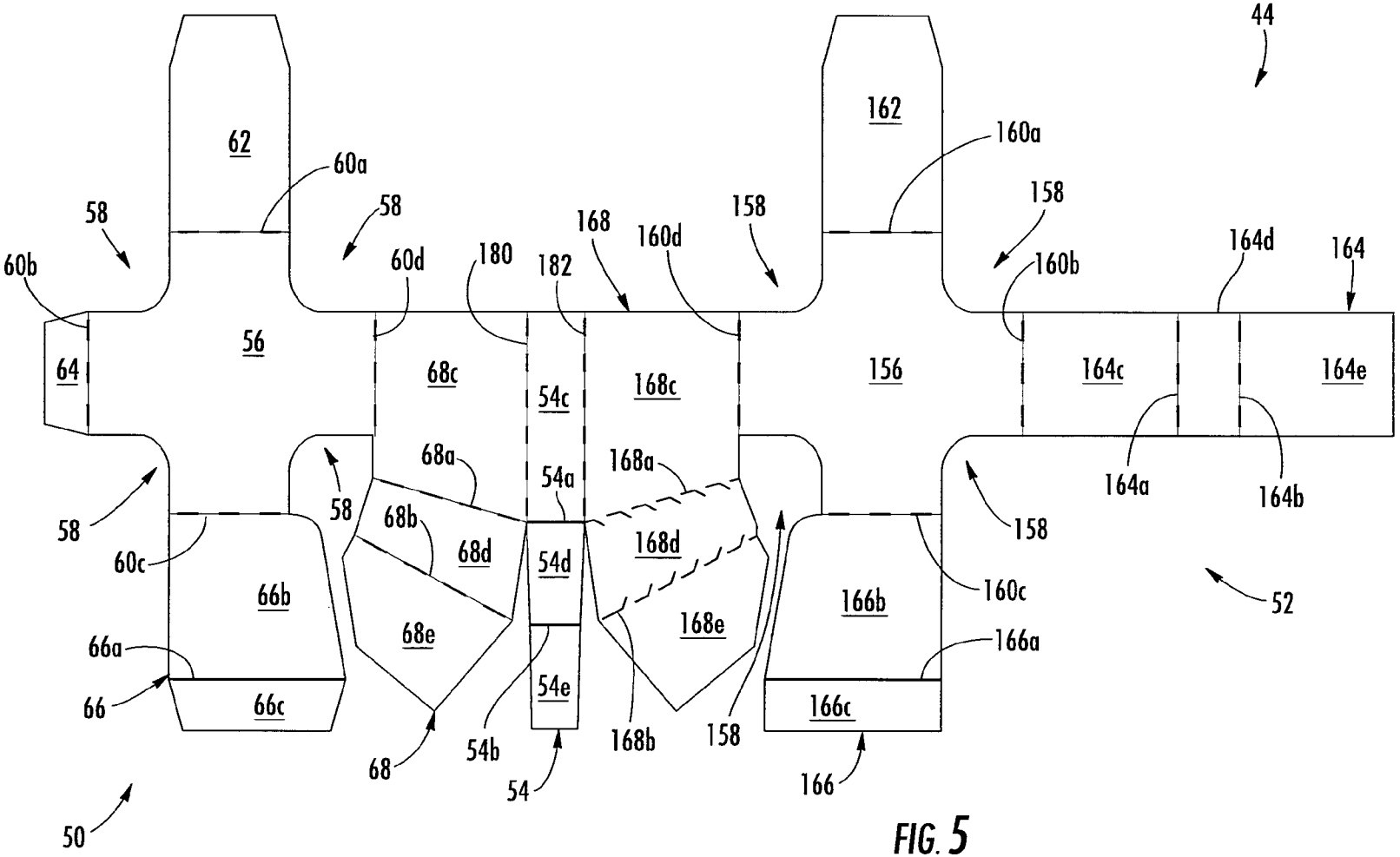
FIG. 5 is a plan view of a blank from which the carton may be erected, in accordance with the exemplary embodiment of this disclosure.

FIG. 5 illustrates an example of a blank 44 from which the carton 24 may be erected, in accordance with the exemplary embodiment. The blank 44 may be characterized in many different ways, such as, for example, as including left and right sections 50, 52 that are foldably connected to one another by way of a connector panel 54. In the following, the left section 50 is discussed first, followed by a discussion of the right section 52, and then a discussion of the connector panel 54.

The left section includes a left central panel 56 that forms the bottom end panel 38 (FIGS. 3 and 4) of the carton 24. The left central panel 56 is shaped like a parallelogram, or more specifically a square, except that each of the corners of the left central panel have been cut away (e.g., beveled or chamfered) to form a hole (i.e., cutout 58) that protrudes inwardly toward the center of the left central panel. More specifically, each of the cutouts 58 is defined by: a convex edge of the central panel that protrudes toward, and is distant from, the center of the left central panel; and two edges that respectively extend outwardly from the opposite ends of the convex edge. The cutouts 58 may be omitted or configured differently. The cutouts 58 may be characterized as being, or defining, recessed corners of the left central panel 56.

Lines of disruption (e.g., fold lines 60*a*, 60*b*, 60*c*, 60*d*) are respectively located at the peripheral edges of the left central panel 56. Each of the fold lines 60*a*, 60*b*, 60*c*, 60*d* extends completely, all the way between adjacent cutouts 58. The left section 50 of the blank 44 further includes top, left and bottom panels (e.g., flaps 62, 64, 66) and a curved left panel 68 that are respectively foldably connected to the left central panel by the fold lines 60*a*, 60*b*, 60*c*, 60*d*. The bottom flap 66 includes a line of disruption (e.g., fold line 66*a*) that divides the bottom flap into an inner panel 66*b* and an outer panel 66*c*.

The curved left panel 68 includes lines of disruption (e.g., fold lines 68*a*, 68*b*) that divide the curved left panel into inner, intermediate and outer portions 68*c*, 68*d*, 68*e*. Accordingly, the curved left panel 68 may be characterized as being a plurality of panels, and each of the inner, intermediate and outer portions 68*c*, 68*d*, 68*e* may be referred to as a panel of the plurality of panels.

The fold lines 68*a*, 68*b* of the curved left panel 68 extend obliquely to one another and to each of the fold lines 60*a*, 60*b*, 60*c*, 60*d* at the edges of the left central panel 58, so that the curved left panel 68 curves toward the bottom flap 66. Nonetheless, the bottom flap 66 and the curved left panel 68 do not contact one another so that a gap (or a slit) is defined therebetween. The gap between the bottom flap 66 and the curved left panel 68 is open to the adjacent cutout 58 in the left central panel 56. Similarly, each of the other cutouts 58 in the left central panel 56 are outwardly open.

The right section 52 of the blank 44 is similar to the left section 50 of the blank, except for being a mirror image thereof, and except for variations noted and variations that will be apparent to one of ordinary skill in the art. Due to the similarity, the right section 52 is described more briefly than the left section 50, and components of the right section 52 that are at least generally similar to corresponding components of the left section 50 have reference numbers incremented by 100. Alternatively, the right and left sections of the blank 44 may be more or less similar.

The right section 52 includes a right central panel 156 that is the top end panel 36 (FIGS. 1-4) in the carton 24. Lines of disruption (e.g., fold lines 160*a*, 160*b*, 160*c*, 160*d*) are respectively located at the right central panel's edges that are between the cutouts 158 of the right central panel 156. The cutouts 158 may be characterized as being, or defining, recessed corners of the left central panel 156. The right section 52 of the blank 44 further includes top, right and bottom panels (e.g., flaps 162, 164, 166) and a curved right panel 168 that are respectively foldably connected to the right central panel 156 by the fold lines 160*a*, 160*b*, 160*c*, 160*d*.

The bottom flap 166 includes a line of disruption (e.g., fold line 166*a*) that divides the bottom flap into an inner panel 166*b* and an outer panel 166*c*. The right flap 164 includes lines of disruption (e.g., fold lines 164*a*, 164*b*) that divide the right flap into inner, intermediate and outer panels 164*c*, 164*d*, 164*e*.

The curved right panel 168 includes lines of disruption (e.g., tear lines 168*a*, 168*b*) that divide the curved right panel into an inner portion 168*c*, an intermediate portion or tear strip 168*d*, and an outer portion 168*e*. Accordingly, the curved right panel 168 may be characterized as being a plurality of panels, and each of the an inner portion 168*c*, tear strip 168*d*, and outer portion 168*e* may be referred to as a panel of the plurality of panels.

The tear lines 168*a*, 168*b* in the curved right panel 168 extend obliquely to one another and to each of the fold lines 160*a*, 160*b*, 160*c*, 160*d* at the edges of the right central panel 156, so that the curved right panel 168 curves toward the bottom flap 166. A gap (or slit) is defined between the curved right panel 168 and the bottom flap 166, and that gap is open to the adjacent cutout 158 in the right central panel 156. Similarly, each of the other cutouts 158 in the right central panel 156 are outwardly open.

The connector panel 54 includes lines of disruption (e.g., fold lines 54*a*, 54*b*) that divide the connector panel into inner, intermediate and outer portions 54*c*, 54*d*, 54*e*. Accordingly, the connector panel 54 may be characterized as being a plurality of panels, and each of the inner, intermediate and outer portions 54*c*, 54*d*, 54*e* may be referred to as a panel of the plurality of panels. Lines of disruption (e.g., fold lines 180, 182) foldably connect the connector panel's inner portion 54*c* to the curved panels' inner portions 68*c*, 168*c*, respectively. Gaps (or slits) are respectively between the connector panel's intermediate and outer portions 54*d*, 54*e* and the curved panels' intermediate and outer portions 68*d*, 68*e*, 168*d*, 168*e*.

In accordance with one aspect of this disclosure, for example and not for purpose of limitation, the connector panel 54 and curved left and right panels 68, 168 can together be referred to as an assembly of panels positioned between and foldably connected to the first and second central panels 56, 156. In the exemplary embodiment and as shown in FIG. 5, the upper end edges of the connector and curved panels 54, 68, 168 are collinear and proximate one another, although other configurations are within the scope of this disclosure. In the downward direction in FIG. 5, the connector and curved panels 54, 68, 168 extend divergently with respect to one another.

An example of a method of forming the package 20 from the containers 22 and the carton 24/blank 44 is described in the following with continued reference to FIG. 5 and reference to FIGS. 6-11, in accordance with the exemplary embodiment of this disclosure. The left central panel 56 (which carries along the top flap 62, left flap 64 and bottom flap 66) is folded substantially one hundred and eighty degrees along the fold line 60*d*, and then the right flap 164 is folded substantially one hundred and eighty degrees along the fold line 160*b*, so that a marginal end portion of the right flap's outer panel 164*e* overlaps the left flap 64. The right flap's outer panel 164*e* and the left flap 64 are secured to one another in that overlapping configuration, so that the blank 44 is in a substantially flattened "tubular" configuration. Throughout the Detailed Description section of this disclosure, the portions of the blank 44 that are secured to one another may be secured using an adhesive material (e.g., glue) and/or any other suitable securing devices, such as, but not limited to, mechanical fasteners.

Figure 6:
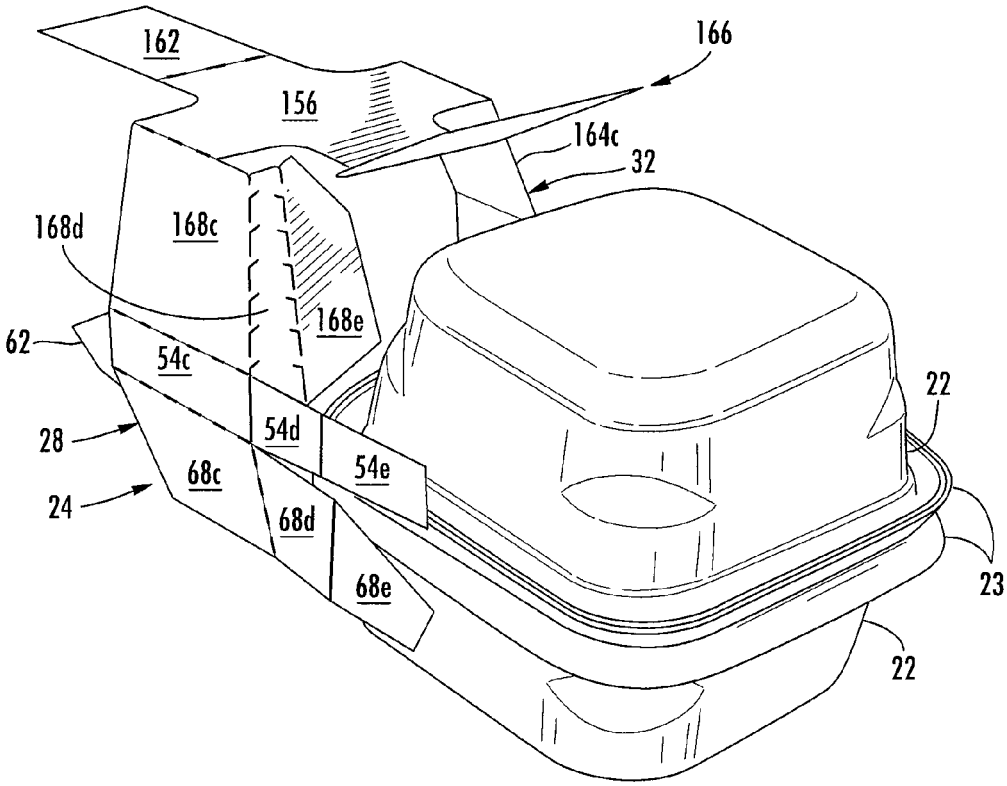
FIGS. 6-11 are pictorial views that partially illustrate an example of a sequence by which the package of FIGS. 1 and 2 may be constructed, in accordance with the exemplary embodiment of this disclosure.

Referring to FIGS. 5 and 6, the flat, tubularly configured carton 24 is opened by folding substantially ninety degrees at each of the fold lines 60*b*, 60*d*, 160*b*, 160*d*, to substantially achieve the open tubular configuration shown in FIG. 6. The front side panel 28 of the carton 20 is formed from (e.g., comprises, consists solely of, or consists essentially of) the curved right panel's inner portion 168*c*, the connector panel's inner portion 54*c* and the curved left panel's inner portion 68*c*. The rear side panel 32 of the carton 20 is formed from (e.g., comprises, consists solely of, or consists essentially of) the secured together left and right flaps 64, 164.

Figure 7:
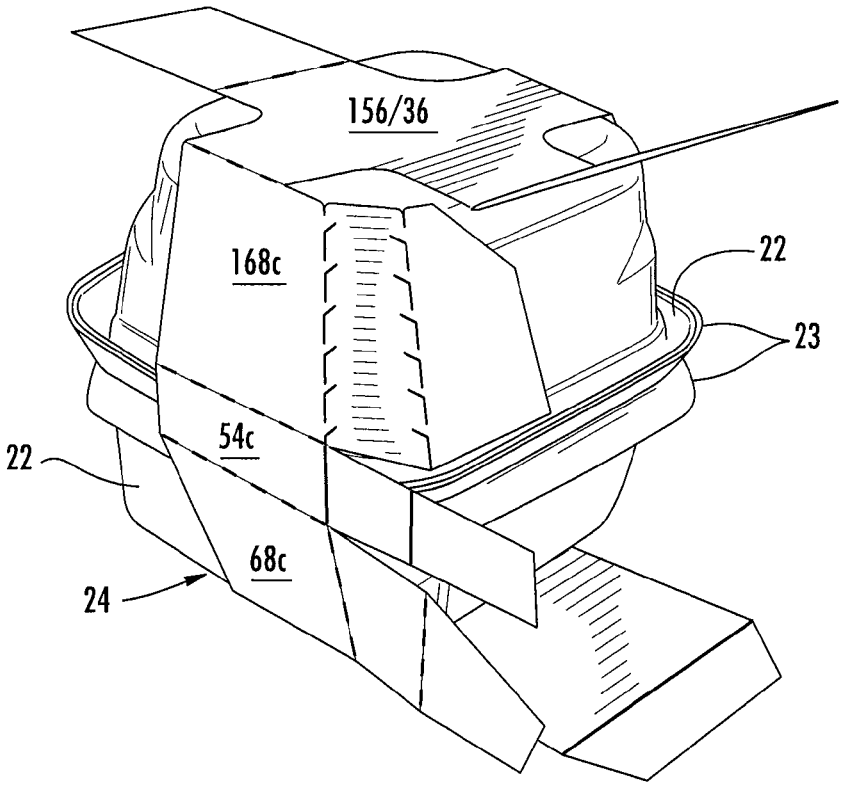

Referring to FIGS. 5 and 7, the containers 22, in their top-to-top configuration, are inserted into the carton 24 in its open tubular configuration, so that the connector panel's inner portion 54*c* and the right flap's intermediate panel 164*d* are pushed outwardly by the protruding lips of the containers 22. As the connector panel's inner portion 54*c* and the right flap's intermediate panel 164*d* are pushed outwardly, folding of about fifteen degrees (e.g., in a range of from about five degrees to about twenty-five degrees, or any other suitable angle) occurs along the fold lines 60*b*, 60*d*, 160*b*, 160*d*, 164*a*, 164*b*, 180, 182. As a result, the right central panel 156/top end panel 36 is lowered, each of the curved panels' inner portions 68*c*, 168*c* become obliquely oriented, each of the right flap's inner and outer panels 164*c*, 164*e* become obliquely oriented, and the left flap 64 becomes obliquely oriented.

Figure 8:
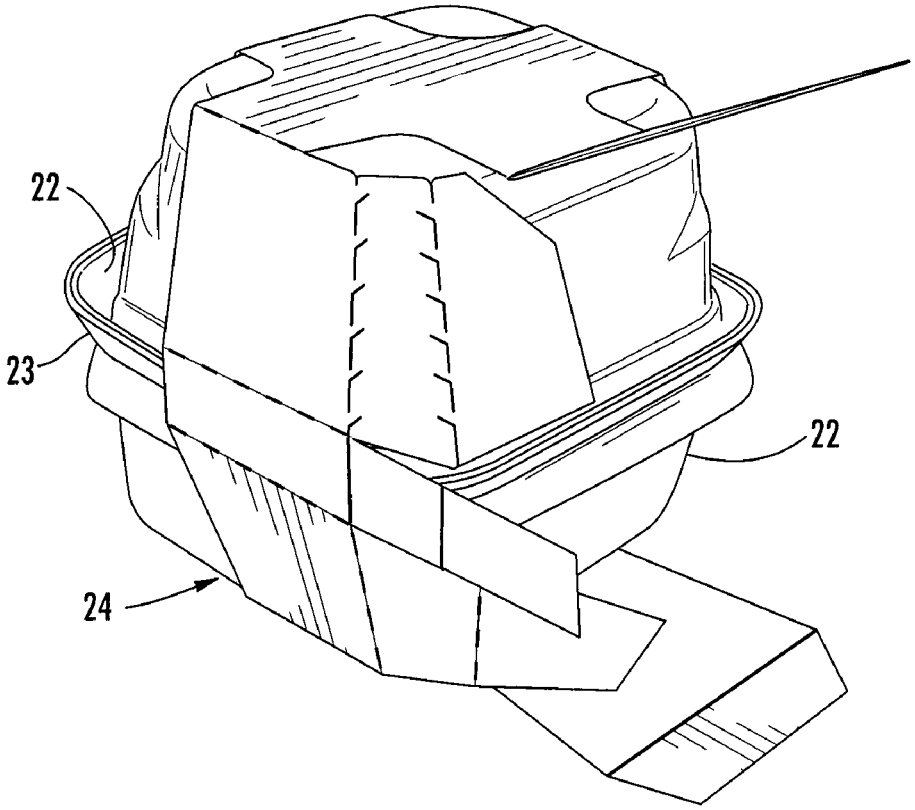

Referring to FIGS. 5 and 8, the top flaps 62, 162 are folded inwardly about seventy-five degrees (e.g., in a range of from about sixty-five degrees to about eighty-five degrees, or any other suitable angle) respectively at the fold lines 60*a*, 160*a*, so that a marginal end portion of the top flap 162 overlaps a marginal end portion of the other top flap 62. The top flaps 62, 162 are secured to one another in that overlapping configuration. The left side panel 34 (FIGS. 2-4) of the carton 20 is formed from (e.g., comprises, consists solely of or consists essentially of) the secured together top flaps 62, 162. The protruding lips of the containers 22 push the middle portion of the left side panel 34 of the carton 20 outwardly, so that the upper and lower portions of the left side panel 34 extend obliquely.

Figure 9:
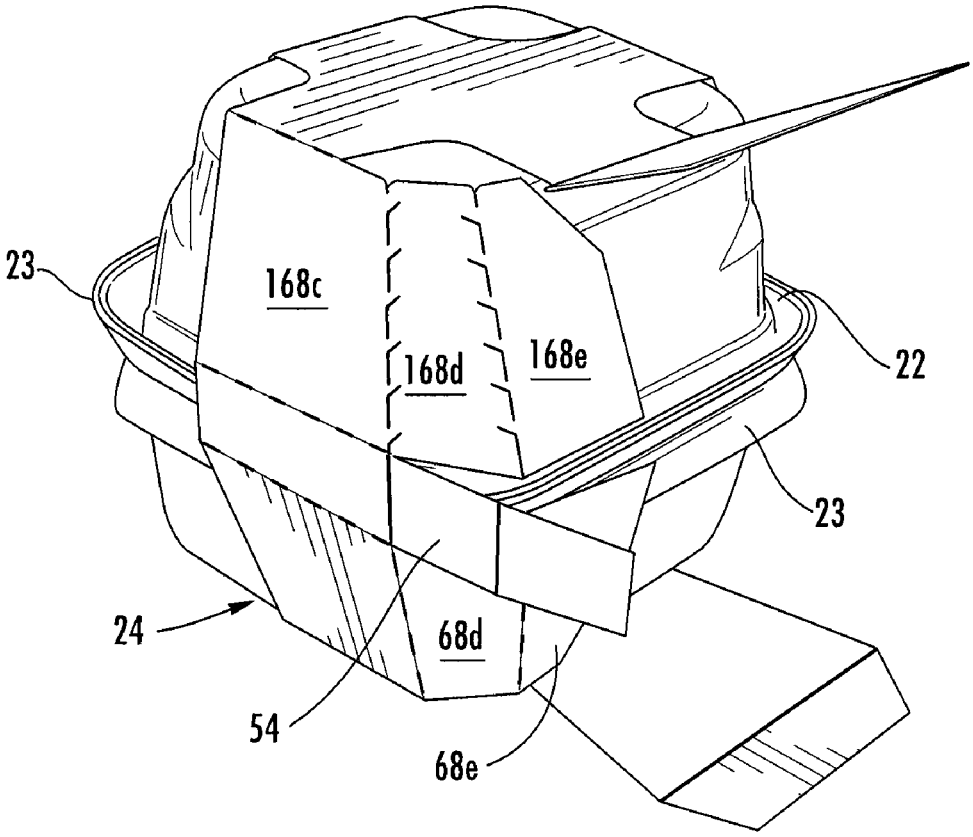
Figure 10:
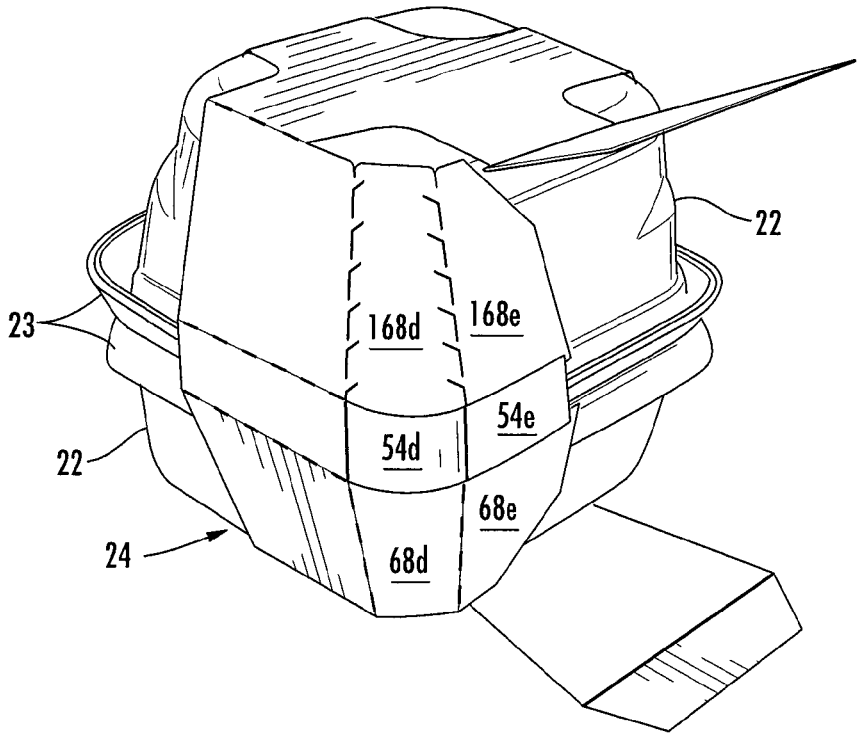

Referring to FIGS. 5 and 9, the curved panels' intermediate and outer portions 68*d*, 68*e*, 168*d*, 168*e* are respectively "wrapped" against the containers 22 by folding along the lines 68*a*, 68*b*, 168*a*, 168*b*, so that the curved panels' intermediate and outer portions 68*d*, 68*e*, 168*d*, 168*e* extend obliquely. Referring to FIGS. 5 and 10, the connector panels' intermediate and outer portions 54*d*, 54*e* are respectively "wrapped" against marginal portions of the curved panels' intermediate and outer portions 68*d*, 68*e*, 168*d*, 168*e*. The wrapping of the connector panels' intermediate and outer portions 54*d*, 54*e* comprises folding along the fold lines 54*a*, 54*b*, so that the connector panels' intermediate portion 54*d* extends obliquely. In accordance with the exemplary embodiment of this disclosure, the connector panels' intermediate and outer portions 54*d*, 54*e* are not directly secured to the curved panels' intermediate and outer portions 68*d*, 68*e*, 168*d*, 168*e*. That is, typically the connector panels' intermediate and outer portions 54*d*, 54*e* are in opposing face-to-face contact with the curved panels' intermediate and outer portions 68*d*, 68*e*, 168*d*, 168*e*, respectively, without there being any adhesive material or other means for securing therebetween. Alternatively, adhesive material or other suitable means for securing may be therebetween.

Figure 11:
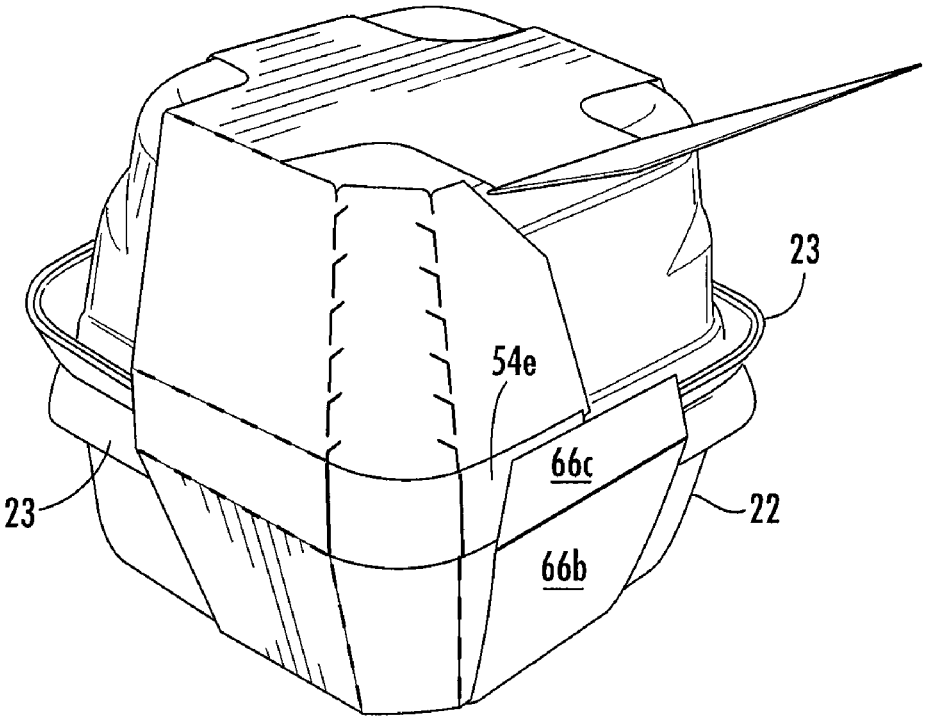

Referring to FIGS. 5 and 11, the bottom flap 66 is folded inwardly about seventy-five degrees (e.g., in a range of from about sixty-five degrees to about eighty-five degrees, or any other suitable angle) at the fold line 60*c*, so that the bottom flap's outer panel 66*c* overlaps the connector panel's end flap 54*e*. The bottom flap's outer panel 66*c* and the connector panel's end flap 54*e* are secured to one another in that overlapping configuration. Referring to FIGS. 1 and 5, the bottom flap 166 is folded inwardly about seventy-five degrees (e.g., in a range of from about sixty-five degrees to about eighty-five degrees, or any other suitable angle) at the fold line 160*c*, so that the bottom flap's outer panel 166*c* overlaps the other the bottom flap's outer panel 66*c*. The bottom flaps' outer panels 66*c*, 166*c* are secured to one another in that overlapping configuration.

The right side panel 30 of the carton 20 is formed from (e.g., comprises, consists solely of, or consists essentially of) the connector panel's outer portion 54*e*, the curved panels' outer portions 68*e*, 168*e* and the bottom flaps 66, 166. The corner panel 40 of the carton 20 is formed from (e.g., comprises, consists solely of, or consists essentially of) the connector panel's intermediate portion 54*d* and the curved panels' intermediate portions 68*d*, 168*d*.

The protruding lips of the containers 22 push the curved panels' intermediate and outer portions 68*d*, 68*e*, 168*d*, 168*e*, the connector panel's intermediate and outer portions 54*d*, 54*e*, and the bottom flaps' outer panels 66*c*, 166*c* outwardly, so that the curved panels' intermediate and outer portions 68*d*, 68*e*, 168*d*, 168*e* and the bottom flaps' inner panels 66*b*, 166*b* extend obliquely.

An example of a method of removing the containers 22 from the carton 24 is described in the following, in accordance with the exemplary embodiment of this disclosure. Referring to FIG. 1, the tear strip 42 may be manually torn away from the carton 24 to initiate the manual opening of the carton. Referring to FIGS. 1 and 5, after the tear strip 42/168*d* is torn away from the carton 24, the connector panel's intermediate portion 54*d* may be manually grasped and pulled to separate the connector panel's outer portion 54*e* from the bottom flaps 66, 166 and unwrap the connector panel 54 from the curved panels' intermediate and outer portions 68*d*, 68*e*, 168*d*, 168*e*. Since the connector panel's outer portion 54*e* is secured (e.g., by adhesive material) to the bottom flap's outer panel 166*c*, when the connector panel's intermediate portion 54*d* is pulled, the pulling may cause relative movement (e.g., relative rotation) between the bottom flaps 66, 166, and that relative movement seeks to at least initiate release of (e.g., substantially eliminate) the connection (e.g., by adhesive material) between the bottom flaps' outer panels 66*c*, 166*c*. The bottom flaps 66, 166 are separated from one another and folded outwardly, and the curved panels' intermediate and outer portions 68*d*, 68*e*, 168*d*, 168*e* may be folded outwardly/unwrapped from the containers 22, so that the connector panel 54, bottom flaps 66, 166 and curved panels 68, 168 are substantially in the configuration shown in FIG. 8, and the containers 22 may be removed from the open carton 24.

Referring to FIG. 5, another embodiment of this disclosure is like the exemplary embodiment, except that portion(s) of the curved panels 68, 168 and/or portion(s) of the connector panel 54 are omitted. More specifically, the curved panels' intermediate and outer portions 68*d*, 68*e*, 168*d*, 168*e* and/or the connector panel's intermediate and outer portions 54*d*, 54*e* may be omitted. As a result and in accordance with one embodiment, the corner panel 40 (FIG. 1) is omitted and the right side panel of the carton is formed from (e.g., consists solely of, or consists essentially of) the bottom flaps 66, 166; therefore, an elongate opening or gap is defined between the front and right side panels of the carton, and the gap between the front and right side panels typically extends into each of the end panels/is contiguous with respective cutouts in the end panels.

In general, the blank 44 may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blank may then be coated with a varnish to protect information printed on the blanks. The blank may also be coated with, for example, a moisture barrier layer, on either or both sides of the blank. The blank can also be laminated to or coated with one or more sheet-like materials at selected panels or panel sections.

One or more of the lines of disruption (e.g., tear lines or fold lines) in the blank 44 may be omitted or reconfigured. For example, depending upon the thickness and rigidity of the material from which the blank is constructed, it may be determined that more or less fold lines in the blank may be desired.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be substantially replaced with a continuous cut line, or the like. For example, a cut line can be a continuous slit or could be wider than a slit without departing from the present disclosure.

As another example, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

Further regarding the containers 22, each container and its lid 23 may be constructed of a polymeric material, such as, but not limited to, a substantially clear or at least generally clear polymeric material. For example, each container 22 and lid 23 may be constructed of clear polypropylene or any other suitable material, whether substantially clear, generally clear, opaque or having any other suitable characteristics. Acceptable containers are sold under the Ziploc Brand by S. C. Johnson & Son, Inc. For example, see U.S. Pat. No. 7,063,231, which is incorporated herein by reference, in its entirety. Notwithstanding the forgoing, any suitable containers may be included in the carton, and the carton may be reconfigured to accommodate differently sized and shaped containers or any other suitable contents (e.g., a single container or nested containers may be contained in the carton, and the carton may contain one or more items while completely omitting any container or containers). Differently shaped (e.g., round) containers are also within the scope of this disclosure. For example, each of the container(s) and carton may be shaped more like (e.g., substantially like) a rectangular parallelepiped.

Directional references (e.g., upper, lower, upward, downward, left, right, leftward, rightward, top, bottom, above, below, vertical, horizontal, clockwise, and counterclockwise) have been used in this disclosure for ease of understanding and not for the purpose of limiting the scope of this disclosure. Also, in considering the scope of this disclosure, each of the features of this disclosure should be considered in isolation, and in various combinations and subcombinations.

Although the above disclosure has been presented in the context of one or more exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A package, comprising:

a carton comprising opposite end panels, a plurality of side panels extending between the end panels, the plurality of side panels extending at least partially around an interior space of the carton, and the plurality of side panels at least partially defining first, second and third carton openings, wherein the first, second and third carton openings are spaced apart from one another around the interior space of the carton, the plurality of side panels comprises a first side panel, a second side panel, a third side panel and a fourth side panel, at least a portion of the first carton opening is positioned between the first side panel and the fourth side panel, at least a portion of the second carton opening is positioned between the fourth side panel and the second side panel, and at least a portion of the third carton opening is positioned between the second side panel and the third side panel, and a corner panel connected between, and extending obliquely to each of, the first side panel and the third side panel; and a container that is simultaneously within the interior space of the carton, and projecting outwardly from the interior space of the carton through each of the first, second and third carton openings, wherein the corner panel covers a portion of the container.

2. The package according to claim 1, wherein:

the container comprises first, second and third corners projecting outwardly from the interior space of the carton through the first, second and third carton openings, respectively; and the container further comprises a fourth corner that is covered by the cover panel of the carton.

3. The package according to claim 1, wherein the carton is formed from a single blank.

4. The package according to claim 1, wherein:

the first carton opening comprises a gap defined between the first side panel and the fourth side panel;

the second carton opening comprises a gap defined between the fourth side panel and the second side panel; and the third carton opening comprises a gap defined between the second side panel and the third side panel.

5. The package according to claim 1, wherein the first carton opening extends into at least one of the end panels.

6. The package according to claim 5, wherein each of the first, second and third carton openings extends into each of the end panels.

7. The package according to claim 1, wherein:

the container is a first container, and the package comprises a second container that is simultaneously positioned within the interior space of the carton with the first container, and projecting outwardly from the interior space of the carton through each of the first, second and third carton openings.

8. The package according to claim 7, wherein each of the first and second containers comprises first, second and third corners respectively projecting outwardly from the interior space of the carton through the first, second and third carton openings.

9. The package according to claim 7, wherein:

each of the first and second containers comprises a base and a container opening opposite the base, and the container opening is wider than the base;

the container opening of the first container is proximate the container opening of the second container so that the container openings are positioned between the bases; and the plurality of side panels extends convergently toward each of the end panels.

10. The package according to claim 1, wherein the corner panel is connected to the first side panel by an oblique line of disruption.

11. The package according to claim 1, wherein the first side panel comprises an upper portion and a lower portion, and the corner panel comprises:

an upper corner panel that is connected to the upper portion of the first side panel by an upper oblique line of disruption, and a lower corner panel that is connected to the lower portion of the first side panel by a lower oblique line of disruption.

12. The package according to claim 11, wherein:

the first side panel further comprises an upright intermediate portion positioned between the upper and lower portions of the first side panel;

the upper portion of the first side panel extends obliquely from the intermediate portion of the first side panel, so that the upper portion of the first side panel extend both upwardly and inwardly from the intermediate portion of the first side panel;

the lower portion of the first side panel extends obliquely from the intermediate portion of the first side panel, so that the lower portion of the first side panel extend both downwardly and inwardly from the intermediate portion of the first side panel;

the corner panel further comprises an intermediate corner panel positioned between the upper and lower corner panels;

the upper corner panel extends obliquely relative to the intermediate corner panel, so that the upper corner panel extend both upwardly and inwardly relative to the intermediate corner panel; and the lower corner panel extends obliquely relative to the intermediate corner panel, so that the lower corner panel extend both downwardly and inwardly relative to the intermediate corner panel.

13. The package according to claim 12, further comprising:

an inner upper panel that is connected to the upper corner panel by an upper oblique line of disruption, and overlapped by an upper portion of the third side panel;

an inner intermediate panel that is connected to the intermediate corner panel by a line of disruption, and overlapped by an upright intermediate portion of the third side panel; and an inner lower panel that is connected to the lower corner panel by a lower oblique line of disruption, and overlapped by an lower portion of the third side panel.

14. The package according to claim 13, wherein the upper oblique line of disruption connecting the inner upper panel to the upper corner panel is a first tear line, and the upper oblique line of disruption connecting the upper corner panel to the upper portion of the first side panel is a second tear line, so that the upper corner panel is a tear strip.

15. The package according to claim 1, wherein:

for each end panel of the opposite end panels, the end panel comprises a plurality of edges and a plurality of recessed corners, and the recessed corners are respectively positioned between pairs of the edges; and for each recessed corner of the plurality of recessed corners, the recessed corner comprises a substantially convex edge that protrudes toward, and is distant from, a center of the respective end panel of the opposite end panels.

16. A package, comprising:

a carton comprising opposite end panels, a plurality of side panels extending between the end panels, the plurality of side panels extending at least partially around an interior space of the carton, and the plurality of side panels at least partially defining first, second and third carton openings, wherein the first, second and third carton openings are spaced apart from one another around the interior space of the carton, the plurality of side panels comprises a first side panel, a second side panel, a third side panel and a fourth side panel, at least a portion of the first carton opening is positioned between the first side panel and the fourth side panel, at least a portion of the second carton opening is positioned between the fourth side panel and the second side panel, and at least a portion of the third carton opening is positioned between the second side panel and the third side panel, and a tear strip connected between, and extending obliquely to each of, the first side panel and the third side panel, wherein the tear strip covers a portion of a container that is simultaneously within the interior space of the carton and projecting outwardly from the interior space of the carton through each of the first, second and third carton openings.

17. The package according to claim 16, wherein:

the tear strip comprises a corner panel having opposite first and second oblique edges, a first oblique tear line connecting the first oblique edge of the corner panel to the first side panel, and a second oblique tear line connecting the second oblique edge of the corner panel to the third side panel; and the first oblique tear line extends obliquely to the second oblique tear line.

18. A package, comprising:

a carton comprising opposite end panels, a plurality of side panels extending between the end panels, the plurality of side panels extending at least partially around an interior space of the carton, and the plurality of side panels comprising a first side panel, a second side panel, a third side panel and a fourth side panel, wherein for each side panel of the first, second, third and fourth side panels, the side panel comprises an upper portion, a lower portion, and an upright intermediate portion positioned between the upper and lower portions of the side panel, the upper portion of the side panel extends obliquely from the intermediate portion of the side panel, so that the upper portion of the side panel extend both upwardly and inwardly from the intermediate portion of the side panel, and the lower portion of the side panel extends obliquely from the intermediate portion of the side panel, so that the lower portion of the side panel extend both downwardly and inwardly from the intermediate portion of the side panel, and a plurality of carton openings, wherein at least first and second carton openings of the plurality of carton openings are at least partially defined by the plurality of side panels, and the first and second carton openings are spaced apart from one another around the interior space of the carton; and at least one container, wherein the at least one container is simultaneously within the interior space of the carton, and projecting outwardly from the interior space of the carton through both the first and second carton openings.

19. The package according to claim 18, wherein each of the first and second carton openings extends into each of the end panels.

20. The package according to claim 18, wherein the carton is formed from a single blank.

21. The package according to claim 18, wherein the at least one container comprises a stack of containers, and the stack of containers is simultaneously:

within the interior space of the carton, and projecting outwardly from the interior space of the carton through both the first and second carton openings.

22. The package according to claim 21, wherein:

the stack of containers comprises first and second containers, and each of the first and second containers comprises a base and a container opening opposite the base, and the container opening is wider than the base;

the container opening of the first container is proximate the container opening of the second container so that the container openings of the first and second containers are positioned between the bases of the first and second containers; and the plurality of side panels extends convergently toward each of the end panels.

23. The package according to claim 21, wherein:

the first carton opening comprises a gap defined between the first side panel and the fourth side panel;

the second carton opening comprises a gap defined between the fourth side panel and the second side panel; and a third carton opening of the plurality of carton openings comprises a gap defined between the second side panel and the third side panel.

24. The package according to claim 23, wherein the stack of containers comprises corners respectively projecting outwardly from the interior space of the carton through the first, second and third carton openings.

25. The package according to claim 23, wherein the carton further comprises a tear strip connected between the first side panel and the third side panel.

26. A package, comprising:

a carton comprising opposite end panels, wherein for each end panel of the end panels, the end panel includes a plurality of holes that extend through the end panel;

a plurality of side panels extending between the end panels, wherein the plurality of side panels extends at least partially around an interior space of the carton, the plurality of side panels comprises a first side panel, a second side panel, a third side panel and a fourth side panel, a first gap is defined between adjacent edges of the first side panel and the fourth side panel, opposite ends of the first gap are respectively open to and contiguous with a first pair of the holes, a second gap is defined between adjacent edges of the fourth side panel and the second side panel, opposite ends of the second gap are respectively open to and contiguous with a second pair of the holes, a third gap is defined between adjacent edges of the second side panel and the third side panel, and opposite ends of the third gap are respectively open to and contiguous with a third pair of the holes;

a corner panel connected between, and extending obliquely to each of, the first side panel and the third side panel, wherein the corner panel is positioned between a fourth pair of the holes, and the corner panel is adjacent to at least one hole of the fourth pair of the holes; and a container that is simultaneously within the interior space of the carton, and projecting outwardly from the interior space of the carton through each of the first, second and third gaps, wherein the corner panel covers a portion of the container.

27. The package according to claim 26, wherein:

for each end panel of the opposite end panels, the end panel comprises a plurality of edges and a plurality of recessed corners, and the recessed corners are respectively positioned between pairs of the edges; and for each recessed corner of the plurality of recessed corners, the recessed corner comprises a substantially convex edge that protrudes toward, and is distant from, a center of the respective end panel of the opposite end panels.

28. The package according to claim 26, wherein:

the first side panel comprises an upper portion, a lower portion, and an upright intermediate portion positioned between the upper and lower portions of the first side panel;

the upper portion of the first side panel extends obliquely from the intermediate portion of the first side panel, so that the upper portion of the first side panel extend both upwardly and inwardly from the intermediate portion of the first side panel;

the lower portion of the first side panel extends obliquely from the intermediate portion of the first side panel, so that the lower portion of the first side panel extend both downwardly and inwardly from the intermediate portion of the first side panel;

corner panel comprises an upper corner panel, a lower corner panel, and an intermediate corner panel positioned between the upper and lower corner panels;

the upper corner panel extends obliquely relative to the intermediate corner panel, so that the upper corner panel extend both upwardly and inwardly relative to the intermediate corner panel;

the lower corner panel extends obliquely relative to the intermediate corner panel, so that the lower corner panel extend both downwardly and inwardly relative to the intermediate corner panel;

the upper corner panel is connected to the upper portion of the first side panel by an upper oblique line of disruption;

the lower corner panel is connected to the lower portion of the first side panel by a lower oblique line of disruption; and the intermediate corner panel is connected to the intermediate portion of the first side panel by a line of disruption positioned between the upper and lower lines of disruption.

29. The package according to claim 28, further comprising:

an inner upper panel that is connected to the upper corner panel by an upper oblique line of disruption, and overlapped by an upper portion of the third side panel;

an inner intermediate panel that is connected to the intermediate corner panel by a line of disruption, and overlapped by an upright intermediate portion of the third side panel; and an inner lower panel that is connected to the lower corner panel by a lower oblique line of disruption, and overlapped by an lower portion of the third side panel.

30. The package according to claim 29, wherein the upper oblique line of disruption connecting the inner upper panel to the upper corner panel is a first tear line, and the lower oblique line of disruption connecting the upper corner panel to the upper portion of the first side panel is a second tear line, so that the upper corner panel is a tear strip.

* * * * *